US007213634B1

(12) United States Patent
Evans et al.

(10) Patent No.: US 7,213,634 B1
(45) Date of Patent: May 8, 2007

(54) OFFSET MOLD PROCESS

(76) Inventors: Dwight Evans, 15 Timothy Trace, Anniston, AL (US) 36207; Russell Taccone, Sr., deceased, late of Erie, PA (US); by Russell Taccone, legal representative, 417 Cherokee Dr., Erie, PA (US) 16505

( * ) Notice: Subject to any disclaimer, the term of this patent is extended or adjusted under 35 U.S.C. 154(b) by 0 days.

(21) Appl. No.: 11/366,681

(22) Filed: Mar. 2, 2006

(51) Int. Cl.
*B22D 18/06* (2006.01)

(52) U.S. Cl. ..... 164/133; 164/63

(58) Field of Classification Search ..... 164/63, 164/133, 119, 130, 325, 137
See application file for complete search history.

(56) References Cited

U.S. PATENT DOCUMENTS 4,791,977 A * 12/1988 Chandley ..... 164/63
5,163,500 A * 11/1992 Seaton et al. ..... 164/130
5,230,379 A * 7/1993 Voss ..... 164/63
5,494,262 A * 2/1996 McLane et al. ..... 266/45
6,516,869 B2 * 2/2003 Crivellone et al. ..... 164/340
6,543,518 B1 * 4/2003 Bend et al. ..... 164/325

* cited by examiner

*Primary Examiner*—Len Tran
(74) *Attorney, Agent, or Firm*—Richard K Thomson

(57) ABSTRACT

An offset mold process deflects a mold assembly being conveyed along a first path laterally of that path into engagement with a nozzle using a shuttle car. Molten metal is pumped into the mold assembly, which is either a cope and drag mold or a lost foam mold, from below the molded part to eliminate eddy currents which can create incongruities in the molded part. One method of flow cutoff involves movement of a first mold component relative to the bottom board cuts off the flow of molten metal and locks the mold fill in the mold assembly. A second method of flow shutoff usable in the lost foam process involves the engagement of a flow cutoff plunger to cut the flow stream once filling the mold has been completed. In both the cope and drag and lost foam apparatuses, withdrawal of the shuttle car enables molten metal in the feed line to drain into a catch ladle obviating the need to burn embedded sand from the scrap prior to its recycling into the melt.

7 Claims, 3 Drawing Sheets

OFFSET MOLD PROCESS

BACKGROUND AND SUMMARY OF THE INVENTION

The present invention is directed to the field of casting molten metal. More particularly, the present invention is directed to a process for bottom-filling a mold cavity and, then, offsetting the mold relative to the bottom board to cut off flow of the pumped metal and trap the mold fill.

Conventional mold-filling methods involve filling a sand mold from the top through a sprue hole. Such a technique can result in creation of eddy currents which produce defects in the casting. If the defect goes beneath the surface, or if the article is a precision casting, such eddy currents can require scrapping of the entire casting.

At least one attempt to combat these difficulties is taught in U.S. Pat. No. 5,230,379 to Voss. In the Voss patent, clamps and seals are provided to enable the molten metal to be drawn into the mold cavity from the bottom using a vacuum assist. Once the mold is completely filled, the mold can be displaced relative to a cheek mold member which has a plurality of distribution channels, cutting off the feed lines and retaining the molten metal in the mold during curing.

The use of vacuum with seals and clamps limits the application of this technique. Further, such features involve added complexity and expense. Lastly, the metal in the distribution channels remains attached to the finished product as the mold cools, requiring this scrap to be cut loose from the finished product. Further, in order to remelt the detached scrap, the imbedded sand must be first removed from the detached pieces to avoid contamination of the melt. This, too, adds expense to the operation.

It is a object of the present invention to develop a bottom-fill mold technique with broader application than the one taught by Voss. The present invention involves a method of filing a mold assembly with molten metal as the mold assembly is conveyed along a first path, the mold assembly having a first mold component positioned above a bottom board, the bottom board having an entrance port extending horizontally and a feed system including at least one vertically extending runner, the method comprising the steps of a) moving one of the mold assembly and a nozzle laterally of the first path to position the horizontally extending feed port in contact with the nozzle which is supplied with molten metal by a pumping system; b) activating the pumping system causing molten metal to flow into and fill the horizontally extending entrance port, the vertically extending runner, and the mold with molten metal; c) interrupting the flow of molten metal at a particular point in the vertically extending runner trapping the molten metal in the mold; d) moving the mold assembly away from the nozzle; e) draining the molten metal in the vertically extending runner below the particular point and in the horizontally extending entrance port into a ladle for reuse.

The method may also be characterized by the said step of interrupting the flow of molten metal being accomplished by moving the first mold component relative to the bottom board to close the flow path through the vertically extending runner. Preferably, the moving step is accomplished by moving the mold assembly laterally of the path into contact with the nozzle. Alternatively, the moving step can be accomplished by moving the nozzle laterally of the path into contact with the horizontally extending feed port.

When the method is used with a cope and drag molding, the cutoff is preferably accomplished by moving the mold relative to its base. In a lost foam molding process, a valve gate is moved laterally across the vertically extending runner to cutoff flow there through.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
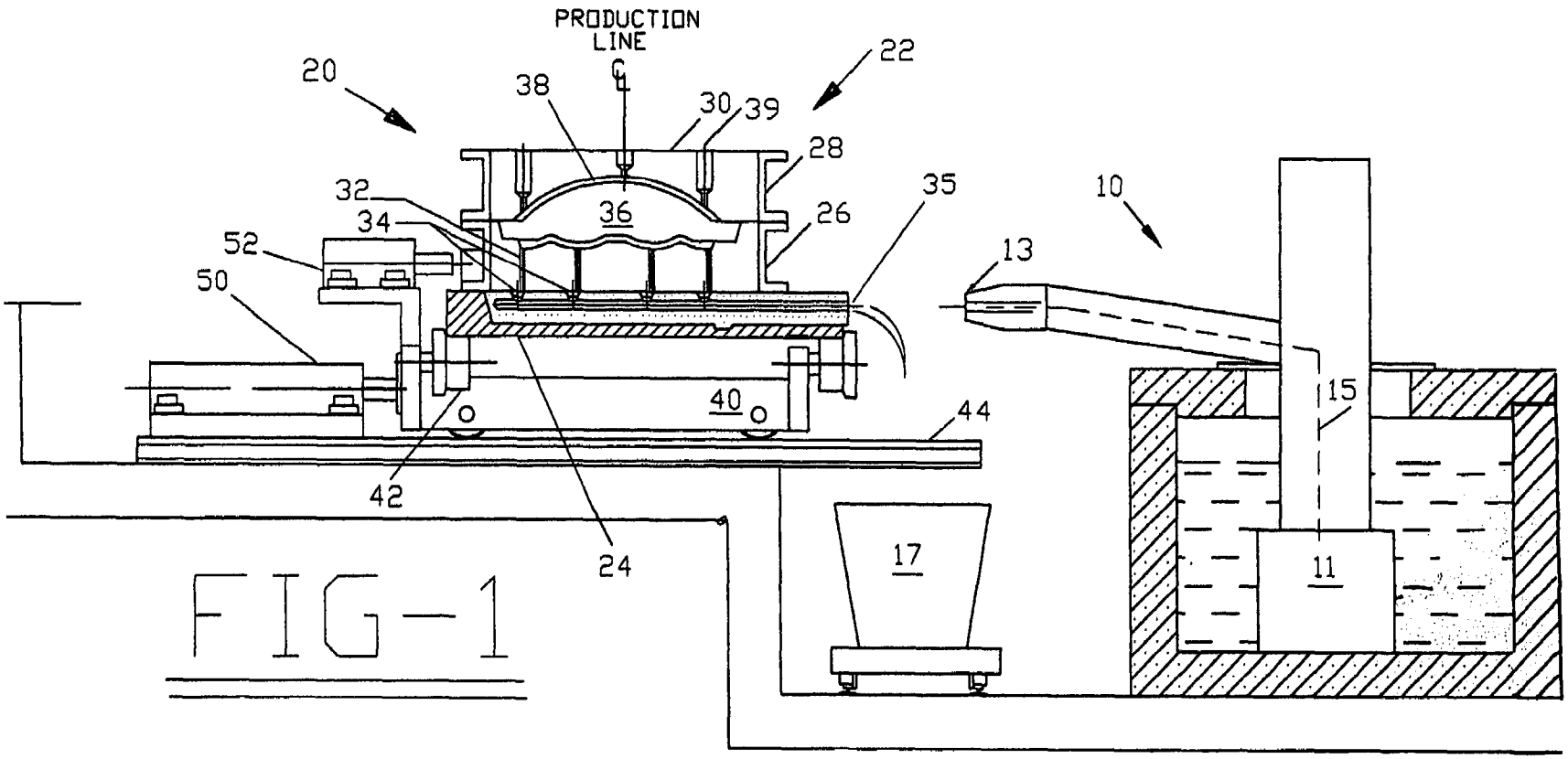
FIG. 1 is a schematic cross-sectional side view of a first embodiment of apparatus used in the offset molding method of the present invention.

A first embodiment of molding apparatus useful in the offset molding method of the present invention is shown in FIG. 1 generally at 20. In the present method, a mold assembly 22 comprised of a mold bottom board 24, a first mold component, in this case, a drag 26 sitting atop the bottom board 24, with a second mold component, in this case cope 28 sitting atop and pinned to drag 26. It is noted that when drag 26 is originally placed on bottom board 24, it, too, was pinned in place. These pins ensure proper alignment of components as the during the construction of the mold, typically from green sand. However, after the formation of the mold assembly 22 is completed, the pins between the drag 26 and bottom board 24 are removed to permit relative movement there between.

As seen in FIG. 1, a separate replaceable sand mold 31 positioned in the bottom board 24 will typically be provided with a horizontal runner 34 with entrance port 35. Primary sand mold 30, also made of green sand, is formed with a plurality of ingates 32 which interconnect with runner 34, a core 36 for a hollow casting which is hung on ears 37, and the space 38 itself which is to be filled with molten metal. It will be understood that the mold cavity 38 is formed by compressing the green sand around a pattern (not shown) which is subsequently removed. When the molten metal fills multiple risers 39, a clear indication is given that the mold has filled properly and the feed pump 11 can be shut off.

Mold assembly 22 is conveyed along a roller conveyor (not shown) until it reaches shuttle car 40 opposite pumping station 10. Bottom board 24 sits atop rollers 42. Hydraulic cylinder 50 translates shuttle car 40 laterally of the conveyor path along rails 44 bringing the entrance 35 of runner 34 into contact with nozzle 13 of fill pipe 15. While in the depicted embodiments, the mold assembly 22 is translated to meet the nozzle 13 of the pumping system 11, it will be understood that the nozzle 13 could be moved to contact the Pump 11 is operated until the molten metal can be clearly seen emerging from risers 39, at which time, a second hydraulic cylinder 52 shifts drag 26 relative to bottom board 24. With ingates 32 misaligned with runner 34, the flow of molten metal is stopped, the mold fill is trapped in the mold assembly 22, and pump 11 is shut off. Hydraulic cylinder 50 retracts shuttle car 40 allowing the molten metal in runner 34 to drain into catch ladle 17. This considerable amount of material does not have to be cut off the completed molded article nor does the embedded sand have to be burned off prior to remelting, as is the case with conventional molding operations. Mold assembly 22 is indexed to a cooling station and another mold moved into position opposite pumping station 10.

Figure 2:
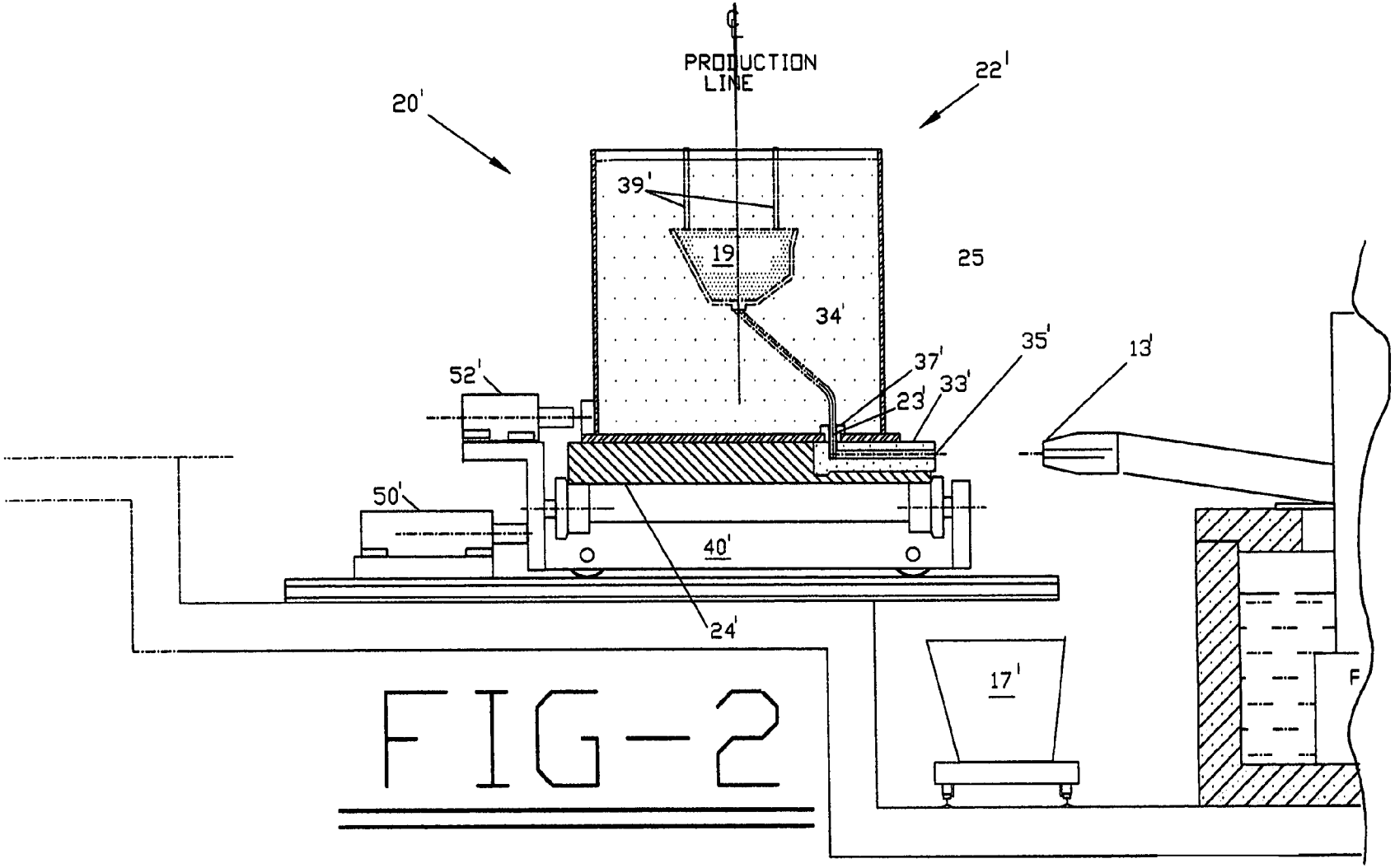
FIG. 2 is a schematic cross-sectional side view of a second embodiment of apparatus useful in the method of the present invention; and, FIG. 3 is a is a schematic cross-sectional side view of a third embodiment of apparatus useful in the present method.

A second embodiment of equipment which can be used with the method of the present invention is depicted in FIG. 2 generally at 20'. Rather than using a drag-cope mold, mold assembly 22' is comprised of a lost foam apparatus. A first mold component in the form of flask 25' sits atop bottom board 24'. A dry sand core 33' forms metal entrance 35' which is shifted into contact with nozzle 13' of pumping station 10' by translating shuttle car 40' laterally. A second dry sand mold 37' seals the opening 23' in flask 25' through which styrofoam runner 34' extends into flask 25'. Styrofoam pattern 19' is inserted in flask 25' with styrofoam vents 39' extending upwardly therefrom. Flask 25' is then filled with dry, unbonded sand which is vibrated to compact it and fill all openings. First hydraulic cylinder 50' translates shuttle car 40' to bring metal entrance 35' into contact with nozzle 13'. Pump 11' is activated to fill the mold until the passageways formed by styrofoam vents 39' are filled. Just as was done with the first embodiment, second hydraulic cylinder 52' shifts flask 25' relative to bottom board (approximately 1.5") to misalign runner 34' relative to dry sand core 33' to seal the mold fill in the flask 25'. Pump 11' is shut off and first hydraulic cylinder 50' moves shuttle car 40' back away from nozzle 13' allowing the molten metal in dry sand mold 33' to drain out of metal entrance 35' and be caught in catch ladle 17'.

Figure 3:
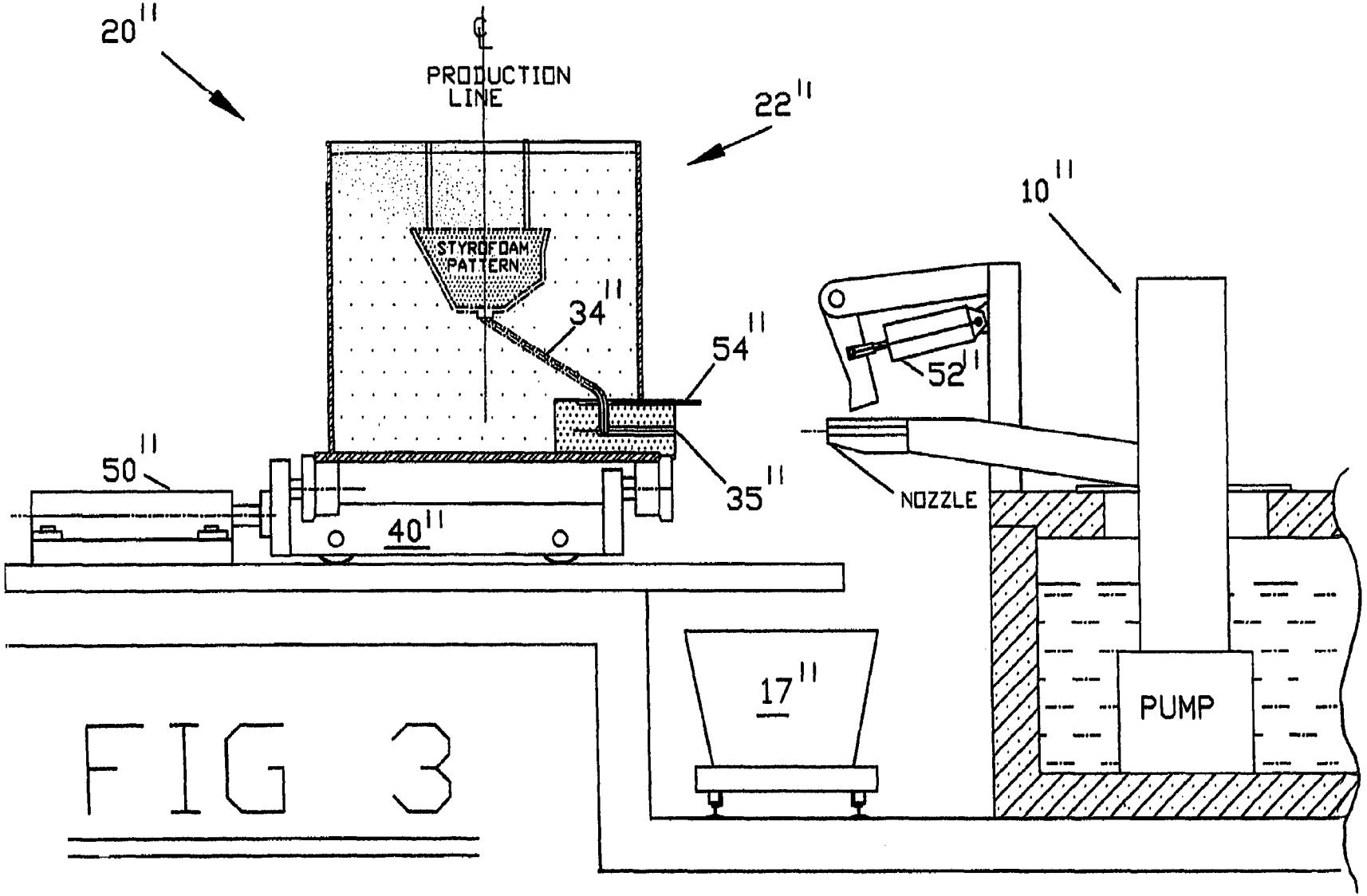

A third embodiment of apparatus useful with the method of the present invention is shown in FIG. 3 generally at 20". This third structural embodiment is similar to the second, also involving a lost foam casting technique. However, in this embodiment, the flow cutoff apparatus is different. The second hydraulic cylinder 52" is mounted on the pumping station 10". When the bottom filling of the mold assembly 22" is completed, second hydraulic cylinder 22" is actuated moving a knife-edge plunger 54" to cutoff flow through runner 34". As with the previous embodiments, when first hydraulic cylinder 50" retracts shuttle car 40", the molten metal remaining in the metal entrance 35" below the cutoff point will drain into the catch ladle 17".

Various changes, alternatives and modifications will become apparent to one of ordinary skill in the art following a reading of the foregoing specification. It is intended that any such changes, alternatives and modifications as fall within the scope of the appended claims be considered part of the present invention.

We claim:

1. A method of filing a mold assembly with molten metal as the mold assembly is conveyed along a first path, the mold assembly having a first mold component positioned above a bottom board, the bottom board having an entrance port extending horizontally and a feed system including at least one vertically extending runner, the method comprising the steps of a) moving one of the mold assembly and a nozzle laterally of said first path to position the horizontally extending feed port in contact with the nozzle which is supplied with molten metal by a pumping system;

b) activating the pumping system causing molten metal to flow into and fill the horizontally extending entrance port, the vertically extending runner, and the mold with molten metal;

c) interrupting the flow of molten metal at a particular point in the vertically extending runner trapping the molten metal in the mold;

d) moving the mold assembly away from the nozzle;

e) draining the molten metal in the vertically extending runner below the particular point and in the horizontally extending entrance port into a ladle for reuse.

2. The method of claim 1 wherein said step of interrupting the flow of molten metal is accomplished by moving the first mold component relative to the bottom board to close the flow path through the vertically extending runner.

3. The method of claim 1 wherein the moving step is accomplished by moving the mold assembly laterally of the path into contact with the nozzle.

4. The method of claim 1 wherein the moving step is accomplished by moving the nozzle laterally of the path into contact with the horizontally extending feed port.

5. The method of claim 1 wherein a valve gate is moved laterally across the vertically extending runner to cutoff flow there through.

6. A method of bottom-filing a flask of a lost foam mold assembly, the lost foam mold assembly including a bottom board with a first dry sand core with a horizontally extending molten metal entrance passage, the flask sitting atop said bottom board and containing a styrofoam pattern, styrofoam vents, and a vertically-extending styrofoam runner connecting the entrance passage to the styrofoam pattern, said method comprising the steps of a) conveying the flask with the lost foam mold assembly in a first longitudinal direction;

b) moving one of the lost foam mold assembly and a nozzle of a molten metal pumping system laterally of the path to bring a fill opening of the mold assembly into contact with the nozzle;

c) activating the pumping system causing molten metal to flow into and fill the horizontally extending entrance passage, a space occupied by the vertically-extending styrofoam runner, and a space occupied by the stryofoam pattern with molten metal;

d) interrupting the flow of molten metal at a particular point in the vertically extending runner trapping the molten metal in the mold;

e) moving the mold assembly away from the nozzle;

f) draining the molten metal in the vertically extending runner below the particular point and in the horizontally extending entrance port into a ladle for reuse.

7. The method of claim 6 wherein said interrupting step is accomplished by activating a hydraulic/pneumatic cylinder to move a valve gate across the vertically extending runner.

* * * * *